United States Patent [19]

Lazarre et al.

[11] Patent Number: 4,490,106

[45] Date of Patent: Dec. 25, 1984

[54] SAFETY DEVICE FOR IGNITING FUEL GASES DISCHARGED BY A FLARE

[75] Inventors: Flavien Lazarre, Pau; Jean Bruneau, St-Germain en Laye, both of France

[73] Assignee: Societe Nationale Elf Aquitaine (Production), Courbevoie, France

[21] Appl. No.: 294,371

[22] Filed: Aug. 19, 1981

[30] Foreign Application Priority Data

Aug. 28, 1980 [FR] France ..... 80 18681

[51] Int. Cl.[3] ..... F23N 1/00

[52] U.S. Cl. ..... 431/90; 431/202; 431/43; 431/61; 431/347; 431/278

[58] Field of Search ..... 431/42, 43, 66, 67, 431/48, 75, 77, 78, 59, 89, 90, 202, 254, 258, 278, 61, 281, 60, 347

[56] References Cited

U.S. PATENT DOCUMENTS

| | | | |
|---|---|---|---|
| 1,296,506 | 3/1919 | Hansen | 431/347 |
| 1,535,240 | 4/1925 | Morris | 431/43 |
| 1,666,331 | 4/1928 | Fisher et al. | 431/43 |
| 1,981,299 | 11/1934 | Beckler | 431/66 X |
| 1,985,991 | 1/1935 | Harrington | 431/66 |
| 2,075,278 | 3/1937 | Hageman | 431/42 |
| 2,734,562 | 2/1956 | Haberle et al. | 431/89 X |
| 3,697,229 | 10/1972 | Frey et al. | 431/202 X |
| 3,718,421 | 2/1973 | McMechan | 431/89 X |
| 3,810,734 | 5/1974 | Willson | 431/258 |
| 3,833,336 | 9/1974 | Ray | 431/202 |
| 3,932,111 | 1/1976 | Liknes et al. | 431/202 |
| 3,968,785 | 7/1976 | Perl | 431/66 X |
| 4,025,281 | 5/1977 | Lapp | 431/278 X |
| 4,207,053 | 6/1980 | Turner et al. | 431/59 |

*Primary Examiner*—Larry Jones
*Assistant Examiner*—Carl D. Price
*Attorney, Agent, or Firm*—James E. Nilles

[57] ABSTRACT

Safety device for igniting fuel gas discharged by the orifice of a flare stack, incorporating a pilot light whose nozzle issues into the vicinity of the orifice of the flare, said pilot light which is equipped with an ignition device is connected by a supply pipe to an auxiliary fuel gas source, said supply pipe being provided with a valve having an opening position and a closing position which are controlled by a mechanism connected by a first servo-system to the detector detecting the admission of the gas to be burned into the flare stack such that the detection of a flow of gas into said stack controls the opening position of the valve and the detection of the stoppage of this flow controls the closing position of the valve, wherein the ignition means of the pilot light comprises a refractory body located in the extension of the nozzle of the pilot light, said solid body being provided with heating means for raising it and maintaining it at a temperature of at least 800° C. and constituting a thermal energy store such that the reduction of its surface temperature due to a stoppage of the heating means is below 50° C. per minute in the range 700° to 1000° C. and wherein the mechanism is connected by a second servo-system to a detector detecting the temperature of the solid body in such a way that the detection of a drop in said temperature to below 800° C. controls the opening position of the valve.

9 Claims, 11 Drawing Figures

SAFETY DEVICE FOR IGNITING FUEL GASES DISCHARGED BY A FLARE

BACKGROUND OF THE INVENTION

The present invention relates to a safety device for igniting fuel gases or gaseous fuels discharged by a flare.

A large number of flare igniter types have already been proposed. They can be placed in two categories, one consisting of devices having a direct thermal action and the other of installations comprising a pilot burner which is itself ignited by a device of the aforementioned category.

In the case of ignition devices with a direct thermal action, the passage of an electric current is generally used to raise a solid body by the Joule effect or a gas volume is ignited by sparking between two electrodes to a temperature exceeding the ignition point of the gas discharged by the flare.

Conventional electrical resistors cannot be continually exposed to the flames of the flare where they would be subject to active abrasion and corrosion and would consequently undergo a very rapid deterioration. When such resistors are used, they are mounted on a mechanism that serves to remove them from the space occupied by the flame as soon as ignition has taken place.

The electrodes of the spark gaps are in turn sensitive to abrasion, corrosion or oxidation, as well as to deposits of carbon black and other solid waste resulting from incomplete combustion. In order to obviate the effects of abrasion and corrosion of electrodes, mechanisms have been designed for maintaining the spacing between the ends of the electrodes at the optimum sparking distance for the electric arc. However, despite these improvements, these mechanisms remain fragile under difficult operating conditions created by the atmosphere surrounding a flare orifice when the flare is operating.

U.S. Pat. No. 4,147,493 of STRAITZ III describes a device making it possible to displace a spark gap and its control means between an ignition position and a position removed from the area surrounding the flare orifice. This installation is complex and in the retracted position, if the flare is extinguished, safety is not completely ensured because to be effective the igniter must be brought into its ignition position close to the flare orifice and said operation cannot be instantaneous.

The various igniters based on a direct thermal action bring about an immediate ignition of the flare when there is a considerable gaseous emission. However, if the discharged volume is small compared with the optimum flow rate for which the flare was designed and as a function of the turbulence of the atmosphere, there can be a significant delay before effective ignition takes place, despite a large number of devices placed around the flare orifice.

Igniters with a pilot light are very widely used. Thus, it has been recognised that the ignition of a flare by means of a gas pilot burner is substantially guaranteed, being independent of the size of the gaseous emission and independent of the orientation and force of the wind and the atmospheric turbulence resulting therefrom.

Moreover, when the composition of the gases to be discharged and destroyed is such that very strict safety precautions must be taken, e.g. when there is a high $H_2S$ content, it is indispensable to provide at least one permanent pilot light supplied with an auxiliary fuel gas.

In the case of large flares, at least two pilot lights are used having symmetrical axes with respect to the flare axis in the vertical plane of the prevailing wind. For even greater security and to take account of unforeseen circumstances, in general four pilot lights are fitted, two in the plane of the prevailing wind and two in the perpendicular plane.

U.S. Pat. No. 2,460,016 (KUHN), U.S. Pat. No. 2,869,631 (ZINK), U.S. Pat. No. 3,537,091 (SCHENKENBERG) and U.S. Pat. No. 3,816,059 (STRAITZ) describe such installations.

Supplying auxiliary fuel gas to two or four pilot lights constitutes a high daily expenditure, which has been hitherto accepted as the price of safety.

BRIEF SUMMARY OF THE INVENTION

A flare installation according to the invention makes it possible to obviate these problems by arranging in a zone substantially on the extended axis of each pilot burner nozzle, but in outwardly spaced relation to the nozzle, a solid body with a large thermal energy store, equipped with means for maintaining it at a temperature well above the emission point of the pilot light gas. The pilot burner is positioned at the end of a supply pipe equipped with a valve, whose opening is controlled either by the detection of a flow to the flare, or by the detection of a temperature drop of the solid body.

A safety device according to the invention for igniting fuel gases discharged by the orifice of a flare stack (1) comprises a pilot light (8), whose nozzle (9) opens out in the vicinity of the orifice of the flare stack (1), and said pilot light (8) is provided with an ignition means (11) and is connected by a supply pipe (10) to an auxiliary fuel gas source. The ignition means (11) for the pilot light (8) comprises a solid body (12) located in an imaginary extension of the nozzle of the pilot light (8). The solid body (12) is provided with heating means for raising it to and maintaining it at a temperature of at least 800° C. and constitutes a thermal energy store, such that the reduction of its surface temperature as a result of the stoppage of the heating means is below 50° C. per minute in the range 700° to 1000° C. The pipe leading to the pilot light is provided with a supply valve (19) having an open position and a closed position, said open and closed positions being controlled by a mechanism (20) connected by a first servo-system (21) to a detector (22) for detecting the admission of the gas to be burned into the flare stack, such that the detection of a gas flow in the flare stack controls the opening of the valve and the detection of the stoppage of this flow controls the closing of the valve. A second servo-system (23) is provided having a detector (24) for detecting the temperature of the solid body (12), such that a reduction of the temperature to below 800° C. brings about the opening of the valve.

A solid body (12) constituting an adequate thermal energy store is made from a material having a high specific heat capacity constituted of elements having such a high specific heat such as carbon, silicon, boron and titanium and chosen more particularly from among the oxides, carbides, silicates or alumino-silicates of said elements.

In order to obtain an additional safety and security in certain devices, the mechanism (20) controlling the supply valve (19) of the pilot light is connected by a third servo-system (28) to a detector (27) for detecting the stoppage of the heating means, such that the detection of said stoppage controls the opening of this supply valve.

When the flare is to be installed on a site where permanent access to a fuel gas source is guaranteed, this fuel gas can be used for heating the solid body (12). In this case, the heating means for the solid body (12) comprises at least one burner (15) that produces a flame which enters an orifice (16) opening into a cavity (13) within the solid body (12), the said cavity also being linked with the atmosphere outside the solid body by at least one orifice for the escape of combustion gases, the burner (15) being connected to a fuel gas source, particularly the fuel gas source to which the pilot light is connected.

When permanent access to a fuel gas source cannot be guaranteed on the flare installation site, arrangements can be made to store a certain quantity of such a gas and in this way it is possible to use a gas burner as the heating means.

When it is not possible to store an adequate quantity of fuel gas, particularly through lack of space or when the replacement of stocks would cause problems, the heating means for the solid body (12) comprises by an electrical resistor (25) located in a cavity (13) within the solid body (12). The cavity (13) opens through at least one orifice through which pass electrical conductors (26) connecting the ends of the resistor (25) to the terminals of an electric power supply. The resistor (25) is made from a material which resists corrosion at temperatures of 800° 1200° C. It is associated with a power regulator such that the increase in the temperature of the resistor leads to a reduction in the available power, so that the temperature of the resistor (25) does not exceed the maximum value for its use.

Under the same conditions and in accordance with a preferred embodiment, the heating means far the solid body (12) comprises an electrical resistor (25) housed in a cavity (13) within the solid body (12), said resistor being made from a material which resists corrosion at temperatures of 800° to 1200° C. and for which the resistivity is a decreasing function of the temperature up to a minimum value corresponding to a given value of the temperature in the range of 800° to 1200° C. and is a rising function of the temperature beyond this given temperature value.

According to other embodiments, the heating means for the solid body comprises the solid body itself, which is made from a material of the type where the resistivity is a decreasing function of the temperature up to a minimum value in the range of 800° to 1200° C. and is a rising function of the temperature beyond this value, said solid body having two separate points, each of which is connected by a conductor to a terminal of an electric power supply.

In installations where an additional guarantee of flare ignition is sought, the ignition device comprises a second pilot light (29), whose nozzle (30) issues in the vicinity of the ignition device (12) of the first pilot light (8), parallel to the axis of the latter, said second pilot light (29) being connected by a supply pipe (31) to a gas intake (32) in the flare stack (1).

In various constructional embodiments, in order to minimise the effects of corrosion on the different parts of the ignition device, the solid body (12) with its heating means (14) is mounted on a device such that the solid body (12) can move from a first position near and in line with the nozzle (9) of a pilot light (8) to a second position spaced laterally away from said nozzle (9), the device being provided with means for locating the solid body in the first position when the supply valve (19) of the pilot light (8) is closed and for placing it in the second position when the supply valve of the pilot light is open.

In various embodiments, it is considered preferable for the solid body to be made from silicon carbide or agglomerated or fritted silicon carbide particles which undergo a heat treatment necessary for giving the solid body an adequate rigidity.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
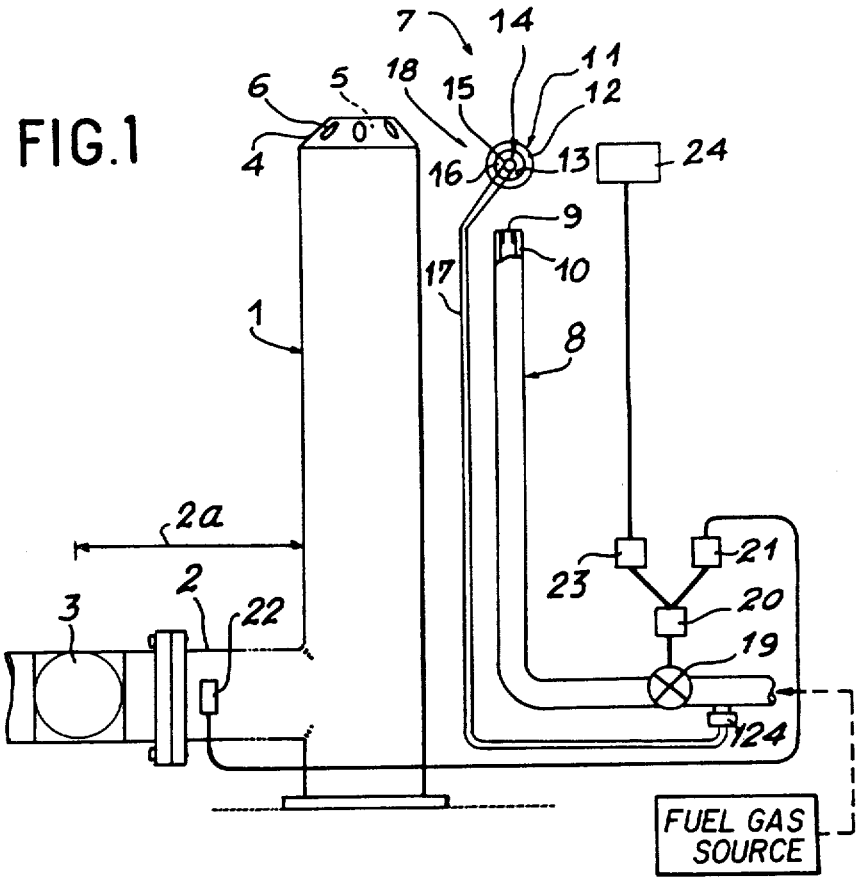
FIG. 1 is an elevation of a flare equipped with a pilot light with an ignition device having a burner.

FIG. 1 diagrammatically shows a flare stack 1, which is in this case vertical but which could also be inclined and even horizontal, for various uses on land and at sea. The flare stack (1) is connected to a pressurized gas source (not shown) by a pipe (2) equipped with a discharge valve (3). Valve (3) is located at an adequate distance from flare stack (1), which distance is designated by reference (2*a*) to ensure that the gases mainly expand before entering the flare stack (1).

Flare stack (1) is generally extended by a frustum-shaped annular ring (4) that defines a coaxial outlet opening (5), whose cross-section is smaller than that of stack (1). Annular ring (4) is generally provided with smaller openings (6) regularly distributed over its contour and called flame retention openings.

Flare stack (1) is equipped with an ignition device (7) incorporating a pilot light (8) comprising a nozzle (9) which forms the outlet of a supply pipe (10) that is connected to a not shown auxiliary fuel gas source and from which gas issues in the vincinity of orifice (5) of flare stack (1).

Figure 4:
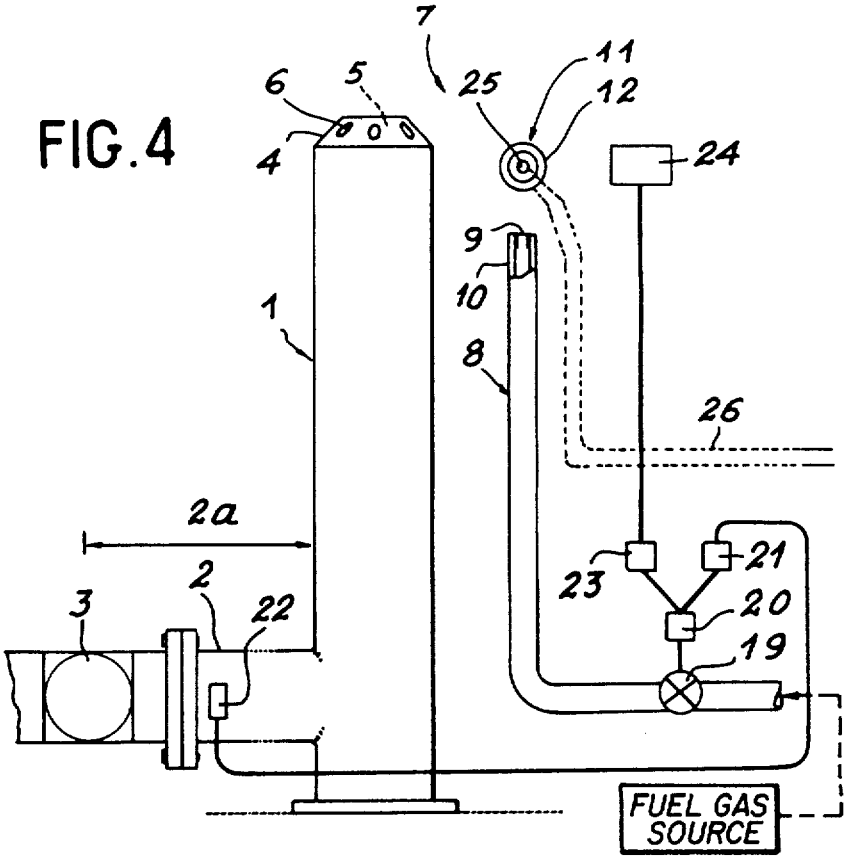
FIG. 4 is an elevation of a flare equipped with a pilot light with an ignition device having an electrical resistor.
Figure 10:
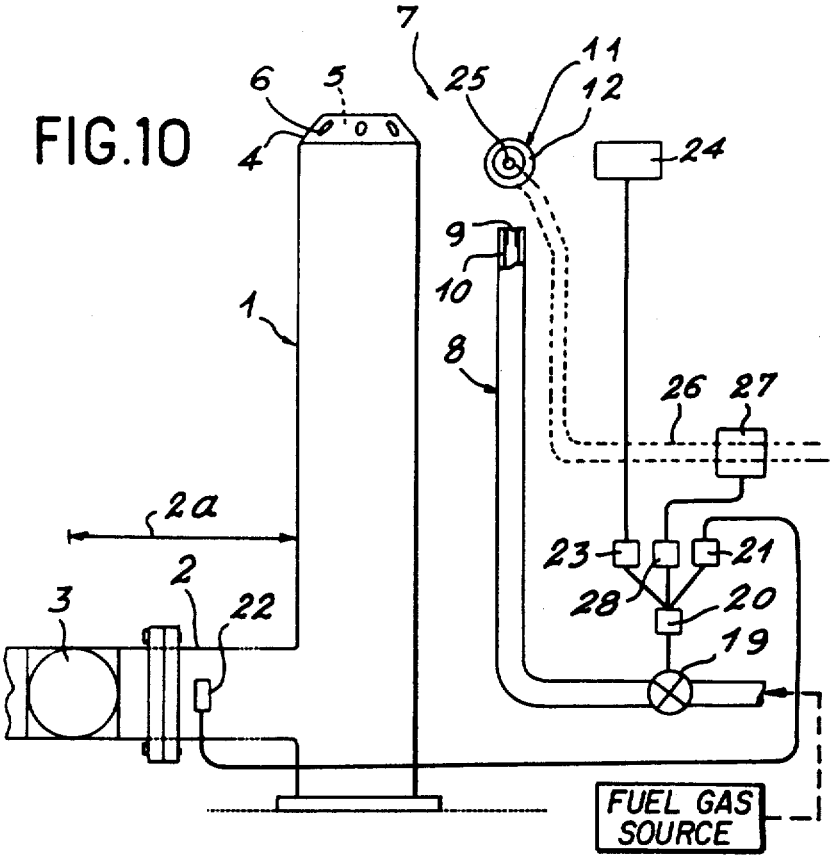
FIG. 10 is an elevation of a flare, equipped with a pilot light, an ignition device comprising an electrical resistor and with safety means controlled by a detector for detecting an interruption of the power supply to the resistor.

In FIG. 1, as well as in FIGS. 4 and 10, a single ignition device (7) is shown. In the various constructions, the number of ignition devices (7) and their distribution about the flare stack (1) are determined both by the cross-sectional size of stack (1) and by statistical data on the wind direction and speed at the site where the flare is to be installed. As a function of the wind direction and speed, large flares designed for discharge at flow rates higher than 1 million cubic meters per day are generally equipped with four pilot lights regularly spaced about the flare stack.

Pilot light (8) is equipped with ignition means (11) which mainly comprises a solid body (12) located at a small distance (a few decimeters) outward from nozzle (9) and nearly in line with it but preferably sufficiently offset with respect to the axis of nozzle (9) to be only in contact with the peripheral part of the flame when the latter is ignited.

Solid body (12) in FIGS. 1 and 4 is shaped like a cylindrical pipe. The feature of the solid body is that it constitutes a large thermal energy store such that the reduction of its surface temperature as a result of a stoppage of the heating means is below 50° C. per minute in the range of 700° to 1200° C., Cylindrical body (12), shown in horizontal form in FIG. 1, can also be inclined or even vertical, particularly when the heating means comprises a gas burner.

As the weight of this body will not exceed a few kilograms, it is indispensable for it to be made from a material with a high specific heat capacity and consequently it is mainly made from elements with a high specific heat capacity such as carbon, silicon or boron. Such a material can advantageously be chosen from among the oxides, carbides, silicates or aluminosilicates of these elements.

This material must have a high resistance both to abrasion by solid particles transported by the pressurized auxiliary fuel gas and to corrosion in a medium which can either be an oxidizing or reducing medium at temperatures of approximately 1000° C. This material must finally take account of the particular corrosiveness of certain constituents of the auxiliary fuel gas present as high percentages or in trace form, e.g. hydrogen sulphide.

These are the characteristics of refractory ceramics, whose compositions take account of the nature of the auxiliary fuel gas. They also apply to silicon carbide, which gives excellent results in the form of fine agglomerated and recrystallized particles.

The cylindrical solid body (12) defines a cylindrical cavity (13) open at its two ends. Cavity (13) houses a heating means (14), in this case comprising a heating burner (15) that projects into the cavity (13) at a terminal orifice (16) and issues into the latter. Burner (15) is connected by a pipe (17) to a pressurized auxiliary gas source. Another end orifice (18) in the solid body, opposite to orifice (16) and not shown in FIGS. 1 and 4, is used for discharging the combustion products of burner (15).

Pipe (10) for supplying pilot burner (8) with auxiliary fuel gas is provided with a valve (19) having an open position and a closed position. The said open and closed positions are controlled by a mechanism (20) connected by a first servo-system (21) to a gas admission detector such as a pressure detector (22) in flare stack (1) or preferably in the cross-section of pipe (2) between valve (3) and flare stack (1) and by a second servo-system (23) to a device (24) for controlling the temperature of solid body (11).

The first servo-system (21) is such that the detection of an admission of gas, particularly by a pressure increase in the flare stack (1) controls the opening of valve (19) and the detection of the end of gas admission controls the closing of valve (19).

The second servo-system (23) is such that the observation of a drop in the temperature of the solid body to below 800° C. controls the opening of valve (19) and the subsequent observation of a rise in the temperature of the solid body to above 1200° C. controls the closing of valve (19).

In FIG. 1, pipe (17) for supplying heating burner (15) with auxiliary fuel gas is branched into the supply pipe (10) for the pilot burner (8) upstream of valve (19) and through a pressure reduction valve 124 that maintains the supply pressure to burner (15) lower than the supply pressure to pilot burner (8).

Figure 2:
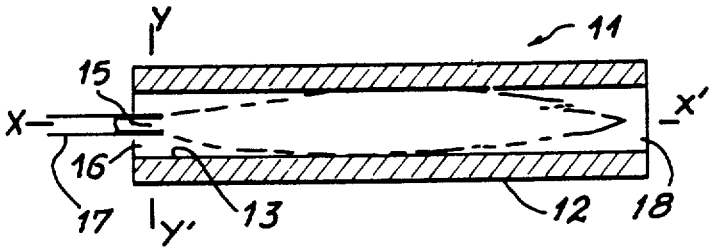
FIG. 2 is a longitudinal section through an ignition device with a burner.

FIG. 2 which is a longitudinal section of an ignition means (11) for a pilot light, shows a solid body (12) shaped like a cylindrical pipe of axis XX' with two end orifices. A nozzle of the heating burner (15) extends through the first orifice (16) and the combustion products of the heating burner (15) are discharged through the second orifice (18).

Figure 3:
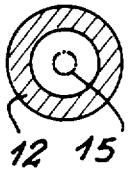
FIG. 3 is a cross-section through an ignition device according to FIG. 2.

FIG. 3 is a cross-section of ignition means (11) on plane YY' viewed from the end of FIG. 2. It is possible to see a section of the solid body (12) and a section of the nozzle of the heating burner (15). The heating burner (15) is itself equipped with a not shown conventional ignition device, such as a sparking device.

FIG. 4 is an elevation of a flare equipped with a pilot light having an ignition device incorporating an electrical resistor. It is possible to see the same components as described relative in FIG. 1 in connection with the actual flare and the pilot light.

A flare stack (1) is connected to a pressurized gas source (not shown) by a pipe (2) equipped with a discharge valve (3). The flare stack (1) is extended by a frustum-shaped annular ring (4) that defines an outlet (5) into the atmosphere having a smaller cross-section than that of stack (1). Ring (4) has openings regularly distributed around its circumference, called flame retention openings.

In the vicinity of opening (5) of flare stack (1) there is an ignition device (7) comprising a pilot burner (8) comprising a nozzle (9) and a pipe (10) that connects this nozzle to a not shown auxiliary fuel gas source. Pilot burner (8) is equipped with an ignition means (11) comprising a solid body (12) positioned a few decimeters outward from the opening of the pilot light nozzle (9).

Figure 5:
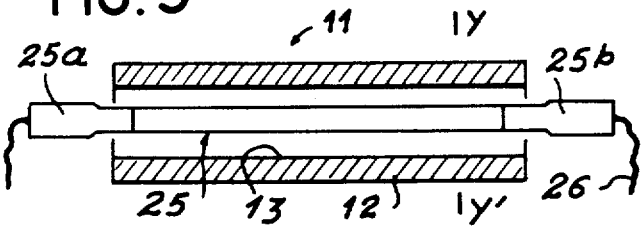
FIG. 5 is a longitudinal section through an ignition device having an electrical resistor.
Figure 6:
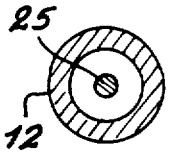
FIG. 6 is a cross-section through the device of FIG. 5.

According to an embodiment illustrated by FIGS. 5 and 6, solid body 12 defines a cylindrical cavity (13) which is open at its two ends. Cavity (13) is used for housing an electrical resistor represented by a coaxial bar (25) having an external diameter smaller than the internal diameter of cavity (13). The feature of solid body (12) is that if forms a large thermal energy store such that its surface temperature drop as a result of a stoppage to the heating means is less than 100° C. per minute in the range 800° to 1000° C.

Thus, the minimum temperature of 700° C. reached after a 1 minute interruption of the heating means is well above the flammability temperature T of the various gases likely to reach the flare, such as $CH_4$ with a temperature of 580° C., $SH_2$ with a temperature of 260° C., ethane at 490° C., propane at 480° C. and butane at 420° C.

Bar (25) can be constituted as a heating element formed from a material which resists corrosion under the thermal conditions of a burner pilot light and whose resistivity in general rises with the temperature. In this case, a not shown power regulator is associated with the electrical supply circuit (26), such that a rise in the temperature of bar (25) leads to a reduction in the available power, in such a way that the temperature of bar (25) does not exceed the maximum value of use.

Bar (25) can advantageously be made from a material such as SiC, whose resistivity is a decreasing function of the temperature up to a minimum value corresponding to a given temperature value in the range 800° to 1000° C. and a rising function of the temperature beyond this given temperature value. When bar (25) is made for such a material, it is protected by an auto-regulation phenomenon from the effects of an excessive rise in its own temperature.

The best results have been obtained for both solid body (12) and bar (25) through the use of silicon carbide in the form of fine particles agglomerated and recrystallized with maximum homogeneity during a high temperature treatment.

In the case of such bars, the non-heating ends (25*a*, 25*b*) are impregnated with metal so as to reduce thermal losses in the ends due to the Joule effect. A few centimeters of the ends are covered with a metal layer in order to minimise the contact resistance with the connecting strands, generally made from the same metal, e.g. aluminium.

Figure 9:
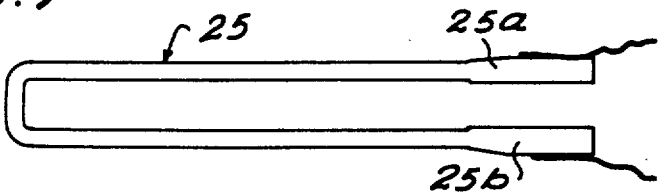
FIG. 9 is a view of a U-shaped resistor.

FIG. 9 shows a U-shaped resistor, which can be installed in a cavity (13) that opens to the outside of body (12) a single orifice (16), which makes it easier to bring the electric conductors into the area adjacent to the pilot light.

In order to increase the resistance value for the same overall dimensions of the heating element, body (12) is given a spiral shape and the U-shaped resistor a double spiral shape. Such constructions are known and not shown.

Figure 7:
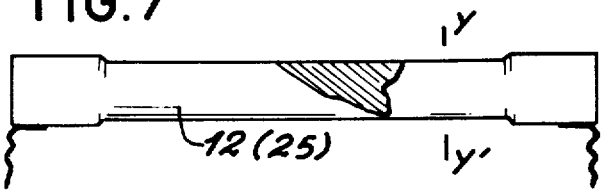
FIG. 7 is a longitudinal section of an ignition device constituted by an electrical resistor.
Figure 8:
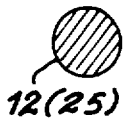
FIG. 8 is a cross-section through the device of FIG. 7.

According to an embodiment illustrated by FIGS. 7 and 8, the solid body (12) is constituted as a bar, which itself forms the heating resistor (25). This bar is made from silicon carbide in the form of fine particles agglomerated and recrystallized with maximum homogeneity by the effect of a heat treatment.

Independently of the construction of solid body 12, it can be seen in FIG. 4 that the pipe (10) for supplying pilot light (8) with auxiliary fuel gas is provided with a valve (19), whose opening and closing are controlled, as in the construction described relative to FIG. 1, by means of a detector (22) for detecting the pressure in the flare stack on the one hand and a detector (24) for detecting the temperature outside body (12) on the other.

FIG. 10 is an elevation of a flare equipped with an ignition device comprising a pilot light (8) with an ignitor comprising an electrical resistor (25), like those described relative to FIGS. 4, 5, 6, 7 and 8. Moreover, with reference to FIG. 10, the supply circuit (26) for resistor (25) has a detector (27) for detecting stoppage of the supply. Detector (27) is connected to a servo-system (28), in turn connected to the control mechanism (20) for valve (19) in the auxiliary fuel gas supply pipe (10).

Detection by detector (22) of an interruption to the heating power supply of bar (25) leads to the opening of valve (19), which constitutes an additional safety feature of the installation.

Figure 11:
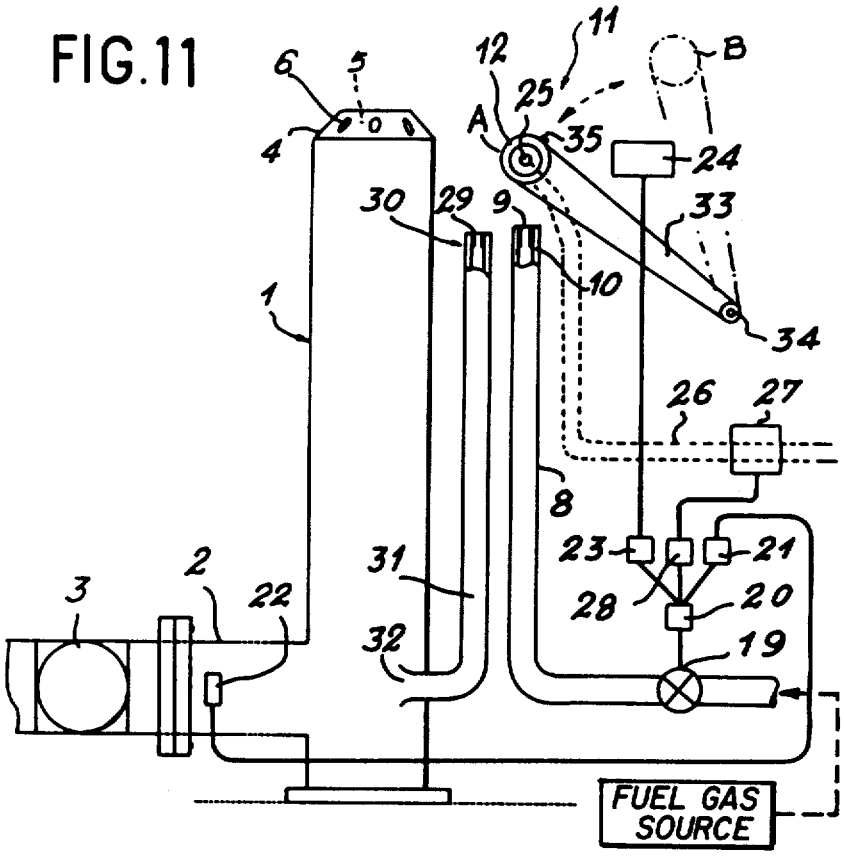
FIG. 11 is an elevation of a flare according to FIG. 10 which also comprises a second pilot light connected by a supply pipe to a gas intake in the flare stack.

FIG. 11 is an elevation of a flare equipped with an ignition device comprising a pilot light (8) with an ignitor incorporating an electrical resistor (25), like those described relative to FIG. 4. This ignition device also comprises a second pilot light (29), whose nozzle (30) issues into the vicinity of ignition device (11) of first pilot light (8), i.e. close to nozzle (9) of the latter. The second pilot light (29) is connected by a supply pipe (31) to a gas intake (32) in the supply pipe to flare (1).

This second pilot light constitutes a final safety means in case an accident on the equipment or the using up of the auxiliary fuel gas reserve leads to an interruption in the auxiliary gas supply and at the same time, despite the intervention of the conventional alarm systems, the installation generating the fuel gas that is to be eliminated by the flare has not been stopped.

FIG. 11 also shows a device comprising an arm (33) which can be oriented about a shaft (34) and which serves as mounting means (35) for solid body (12). This arm is provided with means (not shown) for moving it from a first position A in which solid body (12) is positioned a little outwardly from and substantially in line with the nozzle (9) of pilot light (8) to a second position B in which solid body (12) is positioned at a substantial distance laterally and outwardly from nozzle (9), as well as means for making the first position dependent on the closed position of valve (19) and the second position dependent on the open position of valve (19).

Obviously, the invention is not limited to the embodiments described and represented and numerous variants are possible without passing beyond the scope of the invention.

EXAMPLE

For a flare able to discharge a flow rate of approximately 2 million cubic meters per day, the dimensions of the four pilot lights leads to a continuous consumption of commercial natural gas of approximately 1000 $m^3$/day, this figure often being exceeded when violent winds are blowing.

Using a safety device for igniting the flares, which comprises a heating bar like that described in FIG. 4 and the following drawings, it is possible to estimate the energy consumption as follows:

For an agglomerated silicon carbide bar, e.g. of crusilite and of diameter 28 mm and useful length 450 mm, a total consumption of 3 watts/$cm^2$, i.e. approx. 1 kW makes it possible to maintain the temperature of the bar at between 1000° and 1200° C. under random atmospheric conditions and no matter what the wind speed. Four heating bars of this type have an energy consumption of $4 \times 24 = 96$ kW h/day.

Bearing in mind that 1 $m^3$ of gas produces 9 therms, i.e. approximately 10 kWh and whilst accepting an efficiency coefficient of 25% for the production of electric power, said flare consumes the equivalent of 40 $m^3$ of gas per day, which represents 4% of the gas consumed by the four pilot lights.

The use of a device for igniting the flares according to the invention makes it possible to obtain a considerable energy saving compared with the presently used devices, whilst still maintaining the safety conditions required on such installations.

Moreover, the use of such a device prevents, during the watching or waiting period, any thermal pollution and any radiation effect with the impact which it could have on the environment.

What is claimed is:

1. Apparatus for burning combustible gas, comprising a flare stack having an outlet and through which combustible gas flows for discharge from said outlet, a fuel gas source, and a pilot burner having a nozzle to which fuel gas can be fed from said fuel gas source and which is located adjacent to said outlet so that burning fuel gas, issuing from said nozzle as a pilot flame, ignites combustible gas issuing from said outlet, said apparatus being characterized by:

A. valve means connected between said fuel gas source and said nozzle, having
   (1) a closed condition blocking flow of fuel gas from said source to said nozzle and
   (2) an open condition allowing flow of fuel gas from said source to said nozzle;

B. first detector means having a connection with said valve means and responsive to flow of combustible gas through the flare stack to maintain said valve means in its open condition during such combustible gas flow but otherwise to normally maintain said valve means in its closed condition;

C. a refractory igniter located adjacent to said nozzle to be in the flow path of fuel gas issuing therefrom, said igniter being of a material which, when no heat is supplied thereto, undergoes a reduction of surface temperature of less than 50° C. per minute in the range of temperatures from 1000° C. to 700° C., to provide a thermal energy store;

D. heater means for supplying heat to said igniter to normally maintain its surface above a predetermined temperature on the order of 800° C.; and E. second detector means having a connection with said valve means, said second detector means being so responsive to a function of failure of said heater means that results in a decline of the surface temperature of said igniter to below said predetermined temperature as to cause said valve means to assume its open condition, notwithstanding absence of flow of combustible gas through the flare stack, so that failure of said heater means will not prevent ignition of combustible gas that subsequently flows through the flare stack.

2. The apparatus of claim 1 wherein said heater means comprises a small gas burner connected with said fuel gas source and having an outlet for burning fuel gas that is adjacent to said igniter.

3. The apparatus of claim 2 wherein said igniter is a substantially tubular body and wherein said small gas burner has its outlet for burning fuel gas disposed in substantially concentric relation to said body so that said body substantially surrounds the flame thereat.

4. The apparatus of claim 1 wherein said igniter comprises a body that has a cavity therein, and wherein said heater means comprises
   (1) an electric resistance heater in said cavity and
   (2) electrical supply means connected with said resistance heater for electrically energizing the same.

5. The apparatus of claim 4 wherein said electrical resistance heater is made of a material which
   (1) resists corrosion,
   (2) has a resistivity which decreases with increasing temperature to a minimum temperature value which is in the range of 800° C. to 1200° C., and
   (3) has a resistivity which increases with increasing temperature at temperatures above said minimum temperature value.

6. The apparatus of claim 1 wherein said igniter is a body of electrical resistance material and wherein said heater means comprises electrical supply means connected with said body.

7. The apparatus of claim 1 wherein said heater means comprises an electrical resistance heater and circuit means for supplying electric current to said resistance heater and wherein said second detector means comprises current responsive means arranged to cause said valve means to assume its open position in consequence of the absence of current flow in said circuit means.

8. The apparatus of claim 1 wherein said igniter is made of silicon carbide.

9. The apparatus of claim 1 wherein said igniter is made of agglomerated silicon carbide particles.

* * * * *